US006133812A

United States Patent [19]

Magda

[11] Patent Number: 6,133,812

[45] Date of Patent: Oct. 17, 2000

[54] SWITCHING RELAY WITH MAGNETICALLY RESETTABLE ACTUATOR MECHANISM

[75] Inventor: Martin A. Magda, Salisbury, Md.

[73] Assignee: Relcomm Technologies, Inc., Salisbury, Md.

[21] Appl. No.: 09/316,139

[22] Filed: May 21, 1999

Related U.S. Application Data

[60] Provisional application No. 60/086,253, May 21, 1998.

[51] Int. Cl.[7] ..... H01H 53/00

[52] U.S. Cl. ..... 335/4; 335/5; 333/105

[58] Field of Search ..... 335/4, 5; 333/101, 333/104–108

[56] References Cited

U.S. PATENT DOCUMENTS

| | | | |
|---|---|---|---|
| 3,681,719 | 8/1972 | Treschitta et al. . | |
| 3,739,306 | 6/1973 | Sladek . | |
| 3,764,939 | 10/1973 | Stokes . | |
| 3,808,566 | 4/1974 | Thompson et al. . | |
| 4,150,348 | 4/1979 | Fotlz | 335/4 |
| 4,167,714 | 9/1979 | Flora . | |
| 4,187,416 | 2/1980 | Caro . | |
| 4,198,611 | 4/1980 | Eng . | |
| 4,206,332 | 6/1980 | Veenendaal . | |
| 4,399,439 | 8/1983 | Upadhyayula . | |
| 4,477,781 | 10/1984 | Reuss, Jr. . | |
| 4,502,027 | 2/1985 | Ayasli . | |
| 4,583,061 | 4/1986 | O'Shea . | |
| 4,652,840 | 3/1987 | Kosugi . | |
| 4,695,811 | 9/1987 | Grellmann et al. . | |
| 4,697,056 | 9/1987 | Hoffman . | |
| 4,736,171 | 4/1988 | Minarik . | |
| 4,755,769 | 7/1988 | Katz . | |
| 4,779,065 | 10/1988 | Katz et al. . | |
| 4,795,960 | 1/1989 | Malcolm . | |
| 4,924,196 | 5/1990 | Uyeda . | |
| 4,965,542 | 10/1990 | Nelson | 333/105 |
| 4,982,442 | 1/1991 | Sarokhanian . | |
| 5,047,740 | 9/1991 | Alman . | |
| 5,065,125 | 11/1991 | Thomson et al. . | |
| 5,132,644 | 7/1992 | Knorr . | |
| 5,281,936 | 1/1994 | Ciezarek . | |
| 5,451,918 | 9/1995 | Sun . | |
| 5,471,183 | 11/1995 | Hettlage et al. . | |
| 5,481,073 | 1/1996 | Singer et al. . | |
| 5,712,603 | 1/1998 | Kim et al. . | |
| 5,724,014 | 3/1998 | Leikus et al. . | |

FOREIGN PATENT DOCUMENTS

| | | |
|---|---|---|
| 0577888 A1 | 1/1994 | European Pat. Off. . |

OTHER PUBLICATIONS

Teledyne Electronic Technologies' information on DC–22 Ghz Miniture 2P3T Switches Publication date believed to be Oct. 1993.

Teledyne Electronic Technologies' information on DC–26.5 Ghz Miniture Multi–Throw Switches Publication date believed to be Oct. 1993.

*Primary Examiner*—Lincoln Donovan
*Assistant Examiner*—Tuyẽń Nguyẽn
*Attorney, Agent, or Firm*—Birch, Stewart, Kolasch & Birch, LLP

[57] ABSTRACT

A multipole, multiposition switching relay is provided. The switching relay includes an electromagnetic drive coil having a spring-biased plunger slidably mounted therein. The plunger is operably connected to a switching apparatus for connecting and disconnecting terminals of coaxial connectors. The drive coil pulls the plunger into its hollow center when an electric current is applied to the drive coil. A magnet located near the drive coil creates a magnetic field which maintains the plunger in the drive coil after the electric current has been disconnected from the drive coil, and the switching relay will remain in the chosen state. A second drive coil may be provided which shunts, or reverses, the magnetic field, allowing the plunger to return to its original position due to the biasing force provided by the spring. Energizing the second drive coil automatically resets any previously selected position of the first drive coil to its original position. The second drive coil may be a second electromagnetic coil and plunger assembly like the first, or may be a simple reset solenoid having no switching apparatus associated therewith.

17 Claims, 4 Drawing Sheets

SWITCHING RELAY WITH MAGNETICALLY RESETTABLE ACTUATOR MECHANISM

This application is a non-provisional conversion application of provisional Application No. 60/086,253, filed on May 21, 1998, the entire contents of which are hereby incorporated by reference.

BACKGROUND OF THE INVENTION

1. Field of the Invention

The present invention is directed to a switching relay for moving a plunger to a selected state by energizing a drive coil, and more particularly, to a switching relay (latching) that will remain in the chosen state when voltage is removed from the drive coil. In a preferred form, energizing the selected coil will automatically reset any previously selected position of another drive coil to its original position.

2. Description of the Background Art

Various switching devices are known in the art for selectively making and breaking a set of electrical contacts in order to selectively complete a path for electrical flow or break the path of electrical flow. One such switching device is shown in U.S. Pat. No. 5,712,603. In that switching device, a pair of electromagnets are provided above each end of a ferromagnetic rocker arm, with each end of the rocker arm being connected to electrical switching contacts. Each electromagnet is formed by a coil of wire wound around an iron core. The two electromagnets are alternately energized to pivot the rocker arm back and forth so that the rocker arm causes the electrical contacts to engage one another.

In order to maintain a rocker arm in a selected position, various mechanisms have been developed in the art. For example, a selected electromagnet may remain energized to retain the rocker arm in the selected position. Alternatively, an overcenter magnet arrangement can be utilized to retain the rocker arm in the selected position and the electrical contacts in engagement with one another after electrical energy is removed from the electromagnet. In such a case, it is still necessary to provide a second electromagnet in order to pivot the rocker arm in the opposite direction from the second position to the first position in order to return the electrical contacts to their initial state. Accordingly, two electromagnets must be provided for each rocker arm, greatly increasing the size and cost of the switching device. Further, if an additional switch circuit is provided which must be independently operated, the first position must be reset prior to actuating the additional switch circuit. This type of switching is usually accomplished by complex mechanical sensor contacts and/or solid state electronic sensors.

An alternative arrangement which does not require the use of a second electromagnet is shown in U.S. Pat. No. 3,681,719. Therein, a spring is provided to bias the rocker arm, and thus the electrical contacts, to their initial (failsafe) position. In such a case, the electrical energy must be continuously applied to the electromagnet in order to keep the electrical contacts engaged with one another against the biasing force provided by the spring. Such continuous application of electrical energy is wasteful, produces electromagnetic radiation which may interfere with adjacent components, and may lead to premature burnout of the electrical coil.

Another switching arrangement is shown in U.S. Pat. No. 4,652,840. A solenoid having a plunger slidable therein is biased to an initial position by a compression spring. When the solenoid is energized, the plunger move downwardly against the biasing force of the spring. The plunger engages an electrically conductive bar, which is in turn engaged with a pair of spaced-apart contact surfaces, to thereby form an electrical switch (path). However, the solenoid must remain energized in order to keep the conductive bar engaged with the contact surfaces against the biasing force provided by the spring, and is therefore subject to the same shortcomings set forth above.

SUMMARY OF THE INVENTION

It is one object of the present invention to provide a switching relay which does not require continuous application of electrical energy to the coil in order to retain the rocker arm in an actuated position.

It is a further object of the present invention to provide a switching relay which does not require the use of a second coil for each rocker arm in order to return the rocker arm to its initial position.

It is a further object of the present invention to provide a switching relay wherein a coil of an adjacent second rocker resets a first rocker to its initial position automatically.

It is yet a further object of the present invention to provide a switching relay which will automatically reset any previously set position without requiring complex mechanical sensor contacts and/or solid state electronic sensors.

These and other objects of the present invention are obtained by a switching relay which includes an electromagnetic coil having a spring-biased plunger slidably mounted therein. The plunger is operably connected to a switching apparatus for connecting and disconnecting terminals of coaxial connectors. The coil pulls the plunger into the coil when an electric current is applied to the coil. A permanent magnet located near the electromagnetic coil creates a magnetic field which maintains the plunger in the coil after the electric current has been disconnected from the coil. A second coil may be provided which shunts the magnetic field (i.e. reverses the magnetic field through the first coil plunger), allowing the plunger to release and return to its original position due to the biasing force provided by the spring. The second coil may be a second electromagnetic coil and plunger assembly (contact actuating), or a simple reset coil.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitive of the present invention, and wherein.

DETAILED DESCRIPTION OF THE PREFERRED EMBODIMENTS

Figure 1:
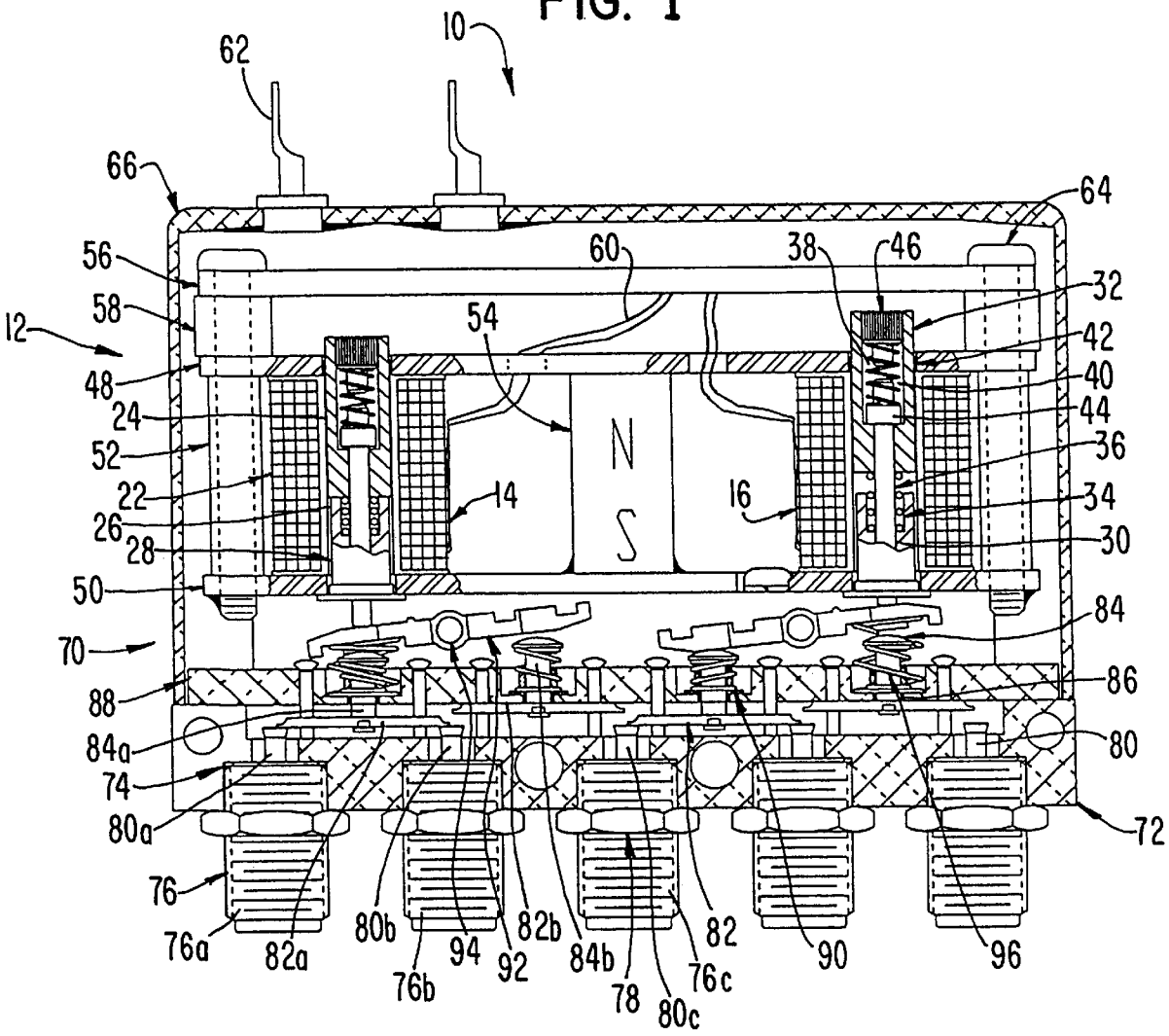
FIG. 1 is a side partially cross-sectional view of a switching relay according to one embodiment of the present invention in a first state.
Figure 2:
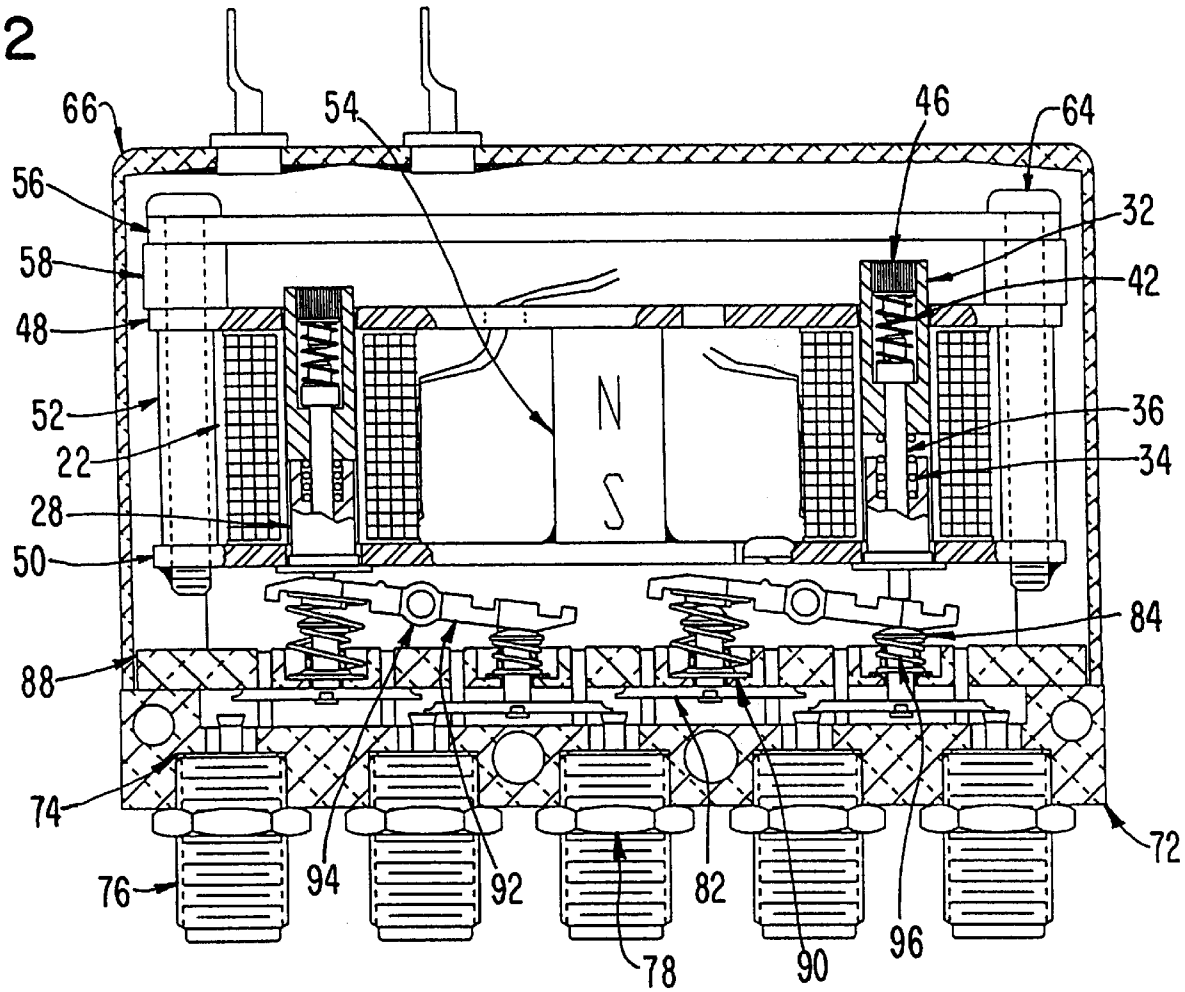
FIG. 2 is a side view of the switching relay shown in FIG. 1 in a second state.
Figure 3:
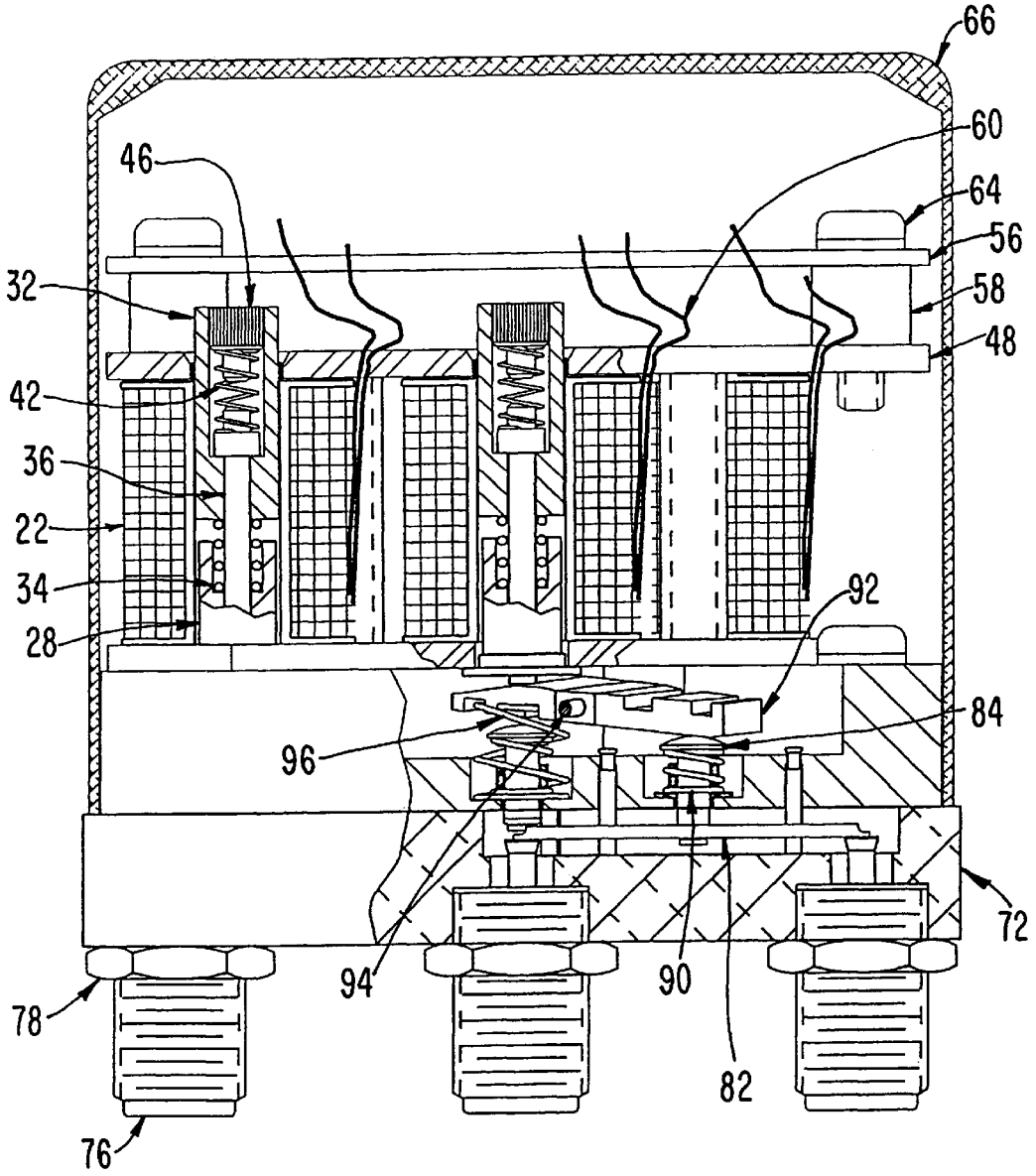
FIG. 3 is a side partially cross-sectional view of a second embodiment of the witching relay according to the present invention.
Figure 4:
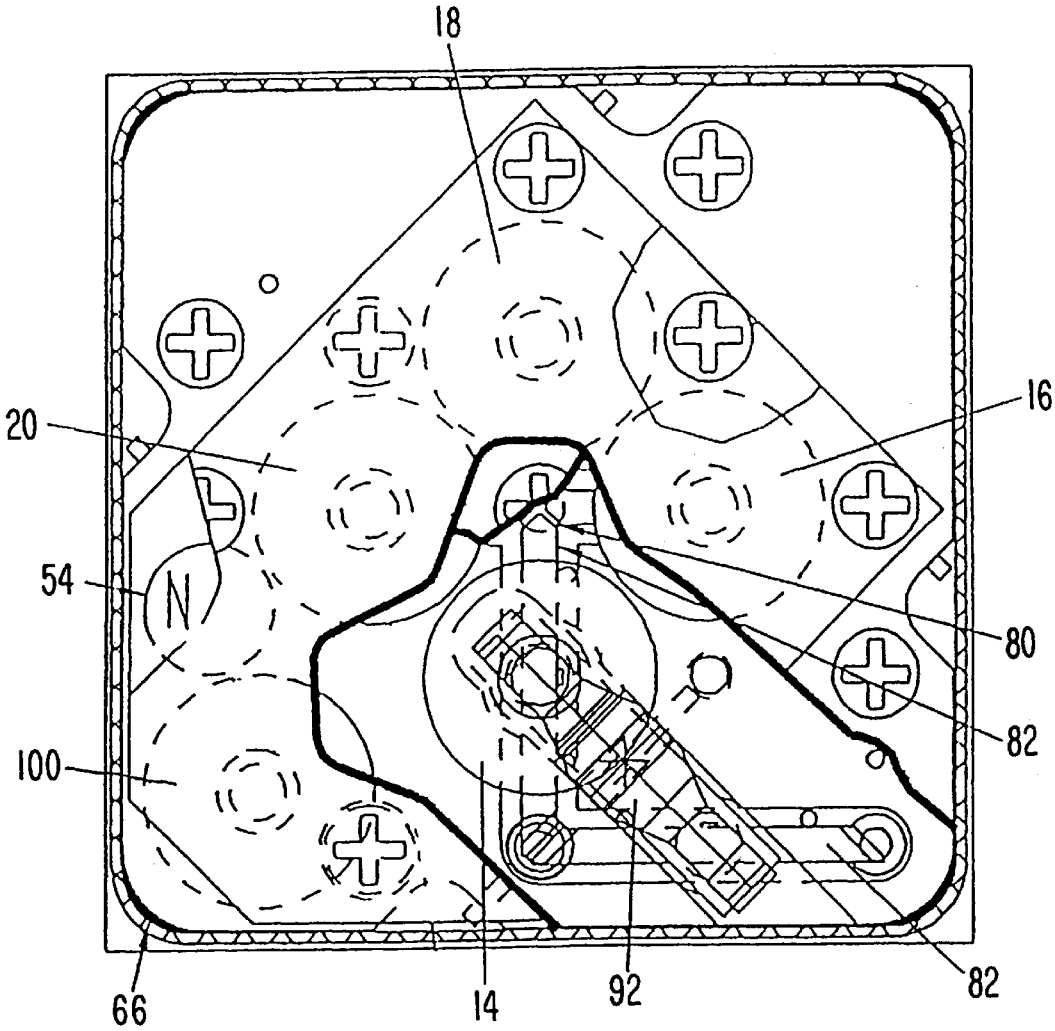
FIG. 4 is a top view of the switching relay shown in FIG. 3.

The present invention will now be described in detail, with particular reference to FIGS. 1 and 2. A switching relay 10 includes an actuator assembly 12 having a first coil assembly 14 and a second coil assembly 16. The second coil assembly 16 is identical to the first coil assembly 14, and therefore, explanation will be made only of the first coil assembly 14 with the understanding that such explanation also applies to the second coil assembly 16. Also, although only first and second coil assemblies 14,16 are shown in FIGS. 1 and 2, the present invention is applicable to third and fourth coil assemblies 18,20 as shown in FIGS. 3 and 4, or any number of coil assemblies.

The first coil assembly 14 includes a first wire coil 22 formed by many windings of wire wound in a single direction around a coil form 24 having a hollow cylindrical center 26. An actuator guide 28 is located within a lower portion of the hollow center 26 of the coil form 24. The actuator guide 28 is formed of a magnetic material, such as iron. The actuator guide 28 has a hollow passage 30 located centrally therein.

A plunger 32 is partially located within an upper portion of the hollow center 26 of the coil form 24 and is slidable between a first position where the plunger 32 is spaced from the actuator guide 28, to a second position where the plunger 32 is in contact with the actuator guide 28. The plunger 32 is also made of a magnetic material, such as iron. A compression spring 34 is located between the plunger 32 and the actuator guide 28 for biasing the plunger 32 toward the first position away from the actuator guide 28.

An actuator pin 36 is slidably located within the hollow passage 30 of the actuator guide 28 for sliding movement together with the plunger 32. The actuator pin 36 may be fixed to the plunger 32, or a compensation mechanism 38 may be utilized to allow for slight relative movement between said actuator pin 36 and the plunger 32. In the compensation mechanism 38, the plunger 32 includes a hollow portion 40. A compression spring 42 is located in the hollow portion 40 between a head 44 of the actuator pin 36 and a cap 46 located in a distal end of the plunger 32.

Application of a current to the first wire coil 22 produces a magnetic field which pulls the plunger 32 into the hollow coil form 24 from the first position to the second position, thereby causing the actuator pin 36 to slide downwardly within the actuator guide 28.

Both the first coil assembly 14 and the second coil assembly 16 are located between a pair of spaced-apart upper and lower coil plates 48,50, which are formed of a magnetically permeable material. Spacers 52 are located between the coil plates 48,50 near edges thereof, and are preferably formed of a nonmagnetic material. As shown in FIGS. 1 and 2, the first coil assembly 14 is spaced laterally from the second coil assembly 16.

A magnet 54 is located in a space adjacent to the first coil assembly 14 and the second coil assembly 16, and in contact with the upper coil plate 48 and the lower coil plate 50. The magnet 54 is preferably a permanent magnet, however, it is conceivable that an electromagnet could also be utilized. The magnet 54 creates a magnetic field in both the area and the magnetically permeable materials which are in the vicinity of the magnet 54. The magnetic field may be disturbed by, for example, an electric current applied to either of the first or second coil assemblies 14,16.

A printed circuit board 56 is spaced above the upper coil plate 48 by spacers 58. The printed circuit board 56 provides a convenient interconnection point between the wires 60 of the coil assemblies 14,16 and external terminals 62. The printed circuit board 56, upper and lower coil plates 48,50, and spacers 52,58, are joined together by a plurality of screws 64. The elements comprising the actuator assembly 12 are enclosed within a cover 66, through which the external terminals 62 penetrate.

As shown in FIG. 1, upon application of electric current to the first wire coil 22 of the first coil assembly 14, the plunger 32 is moved from the first position to the second position. The magnet 54 and the magnetic field created thereby will retain the plunger 32 in the second position after the electric current is disconnected from the first wire coil 22. However, as shown in FIG. 2, application of electric current to the wire coil of the second coil assembly 16 disrupts, or shunts (reverses), the magnetic field in the first coil assembly 14 created by the magnet 54. Accordingly, the magnetic field will no longer retain the plunger 32 in the second position, and the plunger 32 will return to the first position under the biasing force provided by the compression spring 34.

The coaxial switching assembly 70 will now be described with reference to FIGS. 1 and 2. The switching assembly 70 includes a housing 72 having a plurality of threaded apertures 74 therein. The threaded apertures 74 generally include a male coaxial connector 76 to which a female coaxial connector may be attached. However, unused ones of the threaded apertures 74 may instead include a coaxial termination threadably inserted therein. Hex nuts 78 may be used to assist in retaining the male coaxial connectors 76 in place within the threaded apertures 74.

Each male coaxial connector 76 includes a terminal 80 located centrally therein. Adjacent ones of the terminals 80 may be electrically interconnected by conductor blades 82. The conductor blades 82 are movably arranged above ends of the terminals 80 for movement from a first position where a respective blade 82 is spaced from the terminals 80 and an electrical path is not completed by the blade 82, to a second position where a respective blade 82 contacts the terminals 80 and an electrical path is created through the blade 82. A push pin 84 is attached to each of the blades 82 at an approximate midportion of the blade 82. The push pins 84 pass through apertures 86 in a cover plate 88 located above the housing 72. Compression springs 90 are arranged between upper ends of the push pins 84 and the cover plate 88 for biasing the push pins 84, and thus the blades 82, toward the first position.

A rocker 92 is pivotally attached to the cover plate 88 by a dowel 94. The rocker 92 is arrange between adjacent pairs of push pins 84, one of which includes a compression spring 96 for biasing one end of the rocker 92 upwardly. In operation, an upper surface of the rocker 92 is engaged by a lower end of the actuating pin 36 and moved thereby. More particularly, for example, when the first wire coil 22 is energized, the plunger 32 is pulled into the hollow core 26 from the first position to the second position, thereby moving the actuator pin 36 downwardly and pivoting the rocker 92 counterclockwise as viewed in FIG. 1, which in turn presses one of the push pins 84*a* and its associated blade 82*a* downwardly to complete a circuit between the terminal 80*a* of the first connector 76*a* and the terminal 80*b* of the second connector 76*b*, while allowing the other push pin 84*b* and its associated blade 82*b* to move upwardly, thereby opening a circuit between the terminal 80*b* of the second connector 76*b* and the terminal 80*c* of the third connector 76*c*.

Referring now to FIGS. 3 and 4, a second embodiment of the present embodiment will be described. The second embodiment is essentially an extension of the first embodiment applied to a system which additionally includes the third and fourth coil assemblies 18,20 mentioned previously. Except as explained below, the construction of the components of the second embodiment is similar or identical to that of the first embodiment, although the number of components and their layout is different.

In addition to including first through fourth coil assemblies 14,16,18,20, the second embodiment includes a reset coil assembly 100. The reset coil assembly 100 shown is identical to the first through fourth coil assemblies 14,16, 18,20. However, the reset coil assembly 100 is not associated with any switching components, such as the conductor blades 82 and terminals 80 of the first through fourth coil assemblies 14,16,18,20. The reset coil assembly 100, when energized, serves to reset any previously set one of the first through fourth coil assemblies 14,16,18,20. The reset coil assembly 100 is optional, since energizing any one of the first through fourth coil assemblies will also reset any other previously set one of the first through fourth coil assemblies 14,16,18,20. Alternatively, the reset coil assembly 100 may be formed by a simple solenoid having no switching apparatus associated therewith.

As shown in FIG. 4, in the switching assembly of the second embodiment, the pair of conductor blades 82 associated with a respective one of the coil assemblies 14,16, 18,20 are oriented at a right angle, as compared with the blades 82 of the first embodiment which are aligned in a row. This arrangement allows a more compact switching relay to be produced.

Although the present invention has been described with respect to a switching assembly for switching electrical circuits on or off, and in particular, radio frequency (RF) coaxial circuits, it should be understood that the switching assembly may instead be comprised as a fluid switching device (liquid or air) wherein a plurality of valves or other devices are selectively opened or closed, or may be utilized with any device requiring an electromechanical actuator.

Also, the present invention has been described with respect to a first embodiment having a pair of single-pole double-throw switches, and a second embodiment having four single-pole double-throw switches. However, the concepts described herein can be applied to devices from a simple single-pole single-throw switch, to any number of single-pole double-throw switches or multiple-pole double-throw switches. For example, the present invention is particularly applicable for switching RF circuits in any of the arrangements shown in U.S. Pat. No. 5,712,603, the entire contents of which are hereby incorporated by reference.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A switching device comprising:

a first wire coil formed by a plurality of windings of wire wound around a hollow core;

a first plunger rectilinearly slidably mounted within said hollow core for movement between a first plunger first position and a first plunger second position;

a first spring for biasing said first plunger in a direction toward said first plunger first position;

a stationary magnet located outside of said hollow core for producing a magnetic field; and a first coil plate and a second coil plate spaced apart from one another, said first coil plate and said second coil plate being formed of magnetically permeable material, said first wire coil, said magnet, and at least a portion of said first plunger being located between said first coil plate and said second coil plate, wherein energization of said first wire coil causes said first plunger to move from said first plunger first position to said first plunger second position, and said magnetic field provided by said magnet maintains said first plunger in said first plunger second position after electrical energy is removed from said first wire coil.

2. The switching device according to claim 1, further comprising:

a second wire coil formed by a plurality of windings of wire wound around a hollow core, said second wire coil having a second plunger slidably mounted within said hollow core for movement between a second plunger first position and a second plunger second position; and a second spring for biasing said second plunger in a direction toward said second plunger first position, wherein energization of said second wire coil causes said second plunger to move from said second plunger first position to said second plunger second position, said magnetic field provided by said magnet maintains said second plunger in said second plunger second position after electrical energy is removed from said second wire coil, and said energization of said second wire coil disrupts said magnetic field, causing said first plunger to return to said first plunger first position.

3. The switching device according to claim 2, wherein said second wire coil and at least a portion of said second plunger are located between said first coil plate and said second coil plate.

4. The switching device according to claim 1, further comprising a first electrical contact and a second electrical contact, said first electrical contact being interconnected with said first plunger such that said first and second electrical contacts are engaged with one another when said first plunger is in one of said first plunger first position and said first plunger second position.

5. The switching device according to claim 1, further comprising first and second electrical contact points, and a conductor bar for connecting said first electrical contact point to said second electrical contact point, said conductor bar being interconnected with said first plunger such that said first and second electrical contacts are engaged by said conductor bar when said first plunger is in one of said first plunger first position and said first plunger second position.

6. The switching device according to claim 1, wherein said magnet is a permanent magnet.

7. A method of switching comprising the following steps:

providing a first wire coil formed by a plurality of windings of wire wound around a hollow core, said first wire coil having a first plunger rectilinear slidably mounted within said hollow core for movement between a first plunger first position and a first plunger second position;

providing a first spring for biasing said first plunger in a direction toward said first plunger first position;

providing a stationary magnet located outside of said hollow core for producing a magnetic field;

providing a first coil plate and a second coil plate spaced apart from one another, said first wire coil, said magnet, and at least a portion of said first plunger being located between said first coil plate and said second coil plate;

providing electrical energy to said first wire coil to move said first plunger from said first plunger first position to said first plunger second position against a biasing force provided by said first spring; and removing said electrical energy from said first wire coil, wherein said magnetic field provided by said magnet maintains said first plunger in said first plunger second position after said electrical energy is removed.

8. The method of switching according to claim 7, further comprising the following steps:

providing a second wire coil formed by a plurality of windings of wire; and providing electrical energy to the second wire coil, wherein energization of said second wire coil shunts said magnetic field provided by said magnet such that said first plunger returns to said first plunger first position.

9. The method of switching according to claim 8, further comprising the following steps:

providing said second wire coil with a hollow core and a second plunger rectilinearly slidably mounted within said hollow core for movement between a second plunger first position and a second plunger second position; and providing a second spring for biasing said second plunger in a direction toward said second plunger first position, wherein said step of providing electrical energy to said second wire coil moves said second plunger from said second plunger first position to said second plunger second position against a biasing force provided by said second spring.

10. The method of switching according to claim 7, further comprising the following steps:

providing a second wire coil having a hollow core, said second wire coil having a second plunger slidably mounted within said hollow core for movement between a second plunger first position and a second plunger second position;

providing a second spring for biasing said second plunger in a direction toward said second plunger first position; and providing electrical energy to said second wire coil to move said second plunger from said second plunger first position to said second plunger second position against a biasing force provided by said second spring, wherein energization of said second wire coil disrupts said magnetic field provided by said magnet such that said first plunger returns to said first plunger first position.

11. The switching device according to claim 1, further comprising a second wire coil formed by a plurality of windings of wire, said second wire coil being spaced from said first wire coil, wherein energization of said second wire coil disrupts said magnetic field, causing said first plunger to return to said first plunger first position.

12. The switching device according to claim 2, further comprising a first coil form around which said first wire coil is formed, and a second coil form around which said second wire coil is formed.

13. The switching device according to claim 2, further comprising first and second electrical contact points, and a first conductor bar for connecting said first electrical contact point to said second electrical contact point, said first conductor bar being interconnected with said first plunger such that said first and second electrical contacts are engaged by said first conductor bar when said first plunger is in said first plunger second position.

14. The switching device according to claim 13, further comprising a third electrical contact point, and a second conductor bar for connecting said second electrical contact point to said third electrical contact point, said second conductor bar being interconnected with said first plunger such that said second and third electrical contacts are engaged by said second conductor bar when said first plunger is in said first plunger first position.

15. The switching device according to claim 14, further comprising a fourth electrical contact point, and a third conductor bar for connecting said third electrical contact point to said fourth electrical contact point, said third conductor bar being interconnected with said second plunger such that said third and fourth electrical contacts are engaged by said third conductor bar when said second plunger is in said second plunger first position.

16. The switching device according to claim 15, further comprising a fifth electrical contact point, and a fourth conductor bar for connecting said fourth electrical contact point to said fifth electrical contact point, said fourth conductor bar being interconnected with said second plunger such that said fourth and fifth electrical contacts are engaged by said fourth conductor bar when said second plunger is in said second plunger second position.

17. The method of switching according to claim 10, further comprising the step of providing electrical energy to said first wire coil to move said first plunger from said first plunger first position to said first plunger second position against a biasing force provided by said first spring, wherein energization of said first wire coil disrupts said magnetic field provided by said magnet such that said second plunger returns to said second plunger first position.

* * * * *